US008944713B2

(12) United States Patent
Koguchi

(10) Patent No.: US 8,944,713 B2
(45) Date of Patent: Feb. 3, 2015

(54) COSMETIC APPLICATOR AND COSMETIC CONTAINER

(75) Inventor: Tomonori Koguchi, Kawaguchi (JP)

(73) Assignee: Tokiwa Corporation, Nakatsugawa-Shi, Gifu (JP)

( * ) Notice: Subject to any disclaimer, the term of this patent is extended or adjusted under 35 U.S.C. 154(b) by 686 days.

(21) Appl. No.: 13/217,396

(22) Filed: Aug. 25, 2011

(65) Prior Publication Data

US 2012/0082502 A1 Apr. 5, 2012

(30) Foreign Application Priority Data

Sep. 30, 2010 (JP) ..... 2010-221989

(51) Int. Cl.

| | |
|---|---|
| ***A46B 11/00*** | (2006.01) |
| ***A45D 40/26*** | (2006.01) |
| ***A45D 40/20*** | (2006.01) |
| ***A45D 40/24*** | (2006.01) |

(52) U.S. Cl.

CPC ..... *A45D 40/265* (2013.01); *A45D 40/205* (2013.01); *A45D 40/24* (2013.01)

USPC ..... 401/127; 401/126; 401/32

(58) Field of Classification Search

CPC . A45D 40/265; A45D 40/267; A45D 40/268; A45D 34/042; A45D 34/043; A45D 34/045; A45D 34/046; A45D 34/047; A45D 34/048; A46B 9/021; A46B 9/023; A46B 9/026; A46B 9/028; A46B 2200/1053; A46B 2200/106; A46B 2200/3006; A46B 5/00; A46B 5/0004; A46B 5/0008; A46B 5/0012

USPC ..... 401/16, 19, 22–24, 29–33, 126–130; 15/160, 164, 165; 132/218

See application file for complete search history.

(56) References Cited

U.S. PATENT DOCUMENTS

| | | | | |
|---|---|---|---|---|
| 5,121,763 | A * | 6/1992 | Kingsford | 132/317 |
| 7,473,046 | B2 * | 1/2009 | Kraus et al. | 401/117 |
| 8,726,913 | B2 * | 5/2014 | Weigel | 132/218 |
| 2011/0297173 | A1 * | 12/2011 | Anderson et al. | 132/218 |

* cited by examiner

*Primary Examiner* — David Walczak

(74) *Attorney, Agent, or Firm* — Bacon & Thomas, PLLC

(57) ABSTRACT

A cosmetic applicator for applying cosmetic material includes a shaft body, a make-up comb having comb-teeth on an outer peripheral surface of a front end of the shaft body, a make-up applicator housed within the shaft body, a grip portion provided on the shaft body, and an operating portion provided on the grip portion and connected to the make-up applicator. A cosmetic container is provided with the cosmetic applicator and a container main body for accommodating cosmetic material. The make-up applicator is configured to be projected from and housed within the front end of the shaft body due to an operation of the operating unit by a user, thereby make-up by comb or applicator can be applied in a proper manner in accordance with the usage, and risk of adhesion of the cosmetic material is prevented when the make-up is applied by comb, and usability thereof can be improved.

10 Claims, 10 Drawing Sheets

COSMETIC APPLICATOR AND COSMETIC CONTAINER

BACKGROUND OF THE INVENTION

1. Field of the Invention

The present invention relates to a cosmetic applicator for applying cosmetic material and a cosmetic container provided with the cosmetic applicator.

2. Description of the Conventional Art

As a dual-use applicator for eyeliner and mascara in the conventional art, proposed is a cosmetic applicator including an eyeliner brush disposed on a front end of a shaft body, a mascara applicator such as a comb projected outward on an outer peripheral surface of the front end of the shaft body, and a grip portion provided on a base end of the shaft body (see, Japanese Utility Model Registration No. 3159628, for example). With the dual-use applicator, it is possible to apply the mascara on eyelashes by use of mascara applicator, and to apply the eyeliner on the eyelids by use of eyeliner brush.

However, in the aforementioned dual-use applicator, when a user applies cosmetic material on the eyelashes by use of the mascara applicator, the eyeliner brush disposed on the front end of the shaft body comes into contact with the nasal root (the root of the nose), so that the cosmetic material attached on the eyeliner brush may adhere to the nasal root. Accordingly, in order to prevent the cosmetic material from adhering to the nasal root, the user needs to apply the mascara while paying attention to angle and position of the cosmetic applicator, so as not to cause the eyeliner brush to come into contact with the nasal root. Therefore, there is a problem that the usability is very poor for the user.

SUMMARY OF THE INVENTION

It is an object of the present invention to provide a cosmetic applicator and a cosmetic container with improved usability, which are capable of applying make-up with mascara or the like by use of a make-up comb, and make-up with eyeliner or the like by use of a make-up applicator in a proper manner in accordance with the usage, while avoiding a risk of adhesion of the cosmetic material of the make-up applicator when the make-up is applied by the make-up comb.

According to the present invention, there is provided a cosmetic applicator for applying cosmetic material, and the cosmetic applicator comprises a shaft body, a make-up comb having comb-teeth arranged in an axial direction on an outer peripheral surface of the front end of the shaft body, a make-up applicator housed within the shaft body, a grip portion provided on a base end of the shaft body, and an operating portion provided on the grip portion and connected to the make-up applicator, wherein the make-up applicator is projected from and housed within the front end of the shaft body by operating the operating unit by a user.

With such cosmetic applicator, in the case where the make-up is applied by use of the make-up comb having comb-teeth arranged in the axial direction on the outer peripheral surface of the front end of the shaft body, the make-up can be applied in a state in which the make-up applicator is drawn into and housed within the shaft body from the front end thereof. Further, in the case where the make-up is applied by use of the make-up applicator, the make-up applicator which is connected to the operating portion and housed within the shaft body is projected from the front end of the shaft body through the operation of the operating portion by the user. Accordingly, it is possible to apply the make-up by use of make-up comb and the make-up applicator in a proper manner in accordance with the usage thereof, and further to avoid a risk of adhesion of the cosmetic material of the make-up applicator when the make-up is applied by use of make-up comb, and thus it is possible to improve the usability.

Here, as a configuration for effectively realizing the aforementioned advantages, in particular, each of the comb-teeth is formed in a circular-ring shape or a circular-arc shape when viewed from the axial direction, whereas the make-up comb is formed so that a plurality of comb-teeth are arranged in parallel along the axial direction.

Further, as a configuration for effectively realizing the aforementioned advantages, in particular, the make-up comb is formed so that the comb-teeth protruding outward on one side of the shaft body are arranged in parallel in one line along the axial direction.

In addition, as configuration for effectively realizing the aforementioned advantages, in particular, the make-up applicator is configured so as to slide in the axial direction in conjunction with the slide movement of the operating portion in the axial direction, projecting from and housed within the front end of the shaft body.

Further, a cosmetic container according to the present invention is provided with the aforementioned cosmetic applicator and a container main body having an accommodation portion for accommodating cosmetic material. Interior and exterior of the container main body are communicated with each other through an opening neck portion provided on the upper face of the accommodation portion. The grip portion is configured to be attached to the opening neck portion in a detachable manner and functions as a top cover of the cosmetic container. When the grip portion is attached to the opening neck portion, the make-up comb penetrates to the accommodation portion through the opening neck portion. In the case where the grip portion is attached to the opening neck portion during a use state in which the grip portion is detached from the opening neck portion and the make-up applicator is projected from the front end of the shaft body by sliding from an initial position where the make-up applicator being housed within the shaft body due to the slide movement of the operating portion, the cosmetic container is configured so that a component of the cosmetic applicator slides in the opposite direction while abutting on a component of the cosmetic container main body to return the make-up applicator and the operating unit to the initial positions respectively.

According to the cosmetic container of the present invention, even when the user forgets to return the operating portion, and the grip portion serving as the top cover of the cosmetic container is attached onto the opening neck portion while the make-up applicator being projected from the front end of the shaft body, the component of the cosmetic applicator slides in the opposite direction while abutting on the components of the container main body to return the make-up applicator and the operating portion to the initial positions. Therefore, the cosmetic container having an excellent usability can be realized.

Here, as a configuration for achieving the aforementioned advantages, in particular, there is further provided a configuration such that, when the grip portion is attached to the opening neck portion, the leading end portion of the operating portion serving as a component of the cosmetic applicator slides in the opposite direction while abutting on a front surface of the accommodation portion serving as a component of the container main body to return the make-up applicator and the operating portion to the initial positions.

Furthermore, as a configuration for achieving the aforementioned advantages, in particular, there is provided an inner plug portion as a component of the cosmetic main body.

The inner plug portion includes a cylindrical portion that abuts on an inner peripheral surface of the opening neck portion, a flange portion that is continuously provided on the cylindrical portion and abuts on the upper face of the opening neck portion, and a scraping portion provided on the lower portion of the cylindrical portion for scraping an excess amount of cosmetic material adhering to the make-up comb while the make-up comb passing therethrough.

Further, there is provided a projecting portion as a component of the cosmetic applicator for the cosmetic container. The projecting portion is provided in a movable manner in the slide movement direction so as to be pushed out along with the slide movement of the make-up applicator in the projecting direction. When the grip portion is attached to the opening neck portion, the projecting portion slides in the opposite direction while the lower end portion thereof abutting on the flange portion of the inner plug portion, thus returning the make-up applicator and the operating portion to the initial positions.

In this manner, according to the present invention, it is possible to allow the user to apply the make-up by use of make-up comb, and the make-up by use of make-up applicator in a proper manner in accordance with the usage thereof, while avoiding a risk of adhesion of the cosmetic material of the make-up applicator when the make-up is applied by use of make-up comb, and thus the usability thereof can be improved.

DETAILED DESCRIPTION OF PREFERRED EMBODIMENTS

Figure 6:
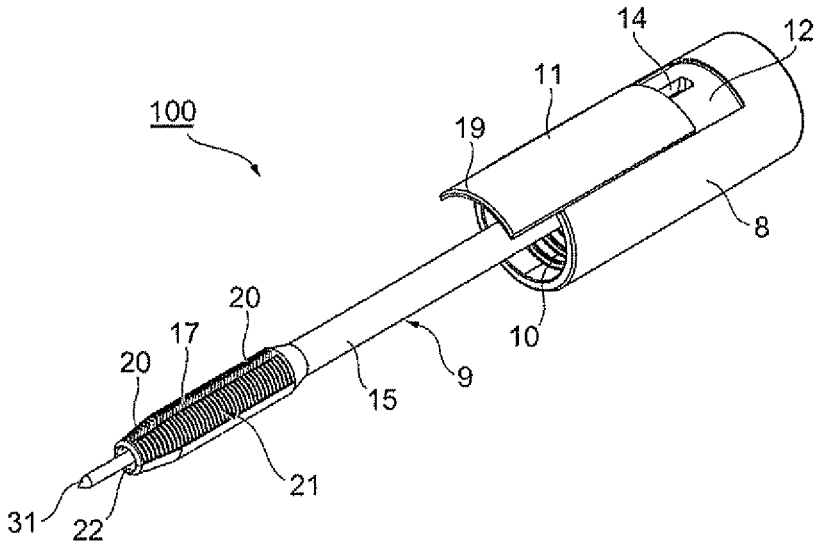
FIG. 6 is a perspective view illustrating a state in which the cosmetic applicator is moved from the state shown in FIG. 4, and positioned in a use position.
Figure 7:
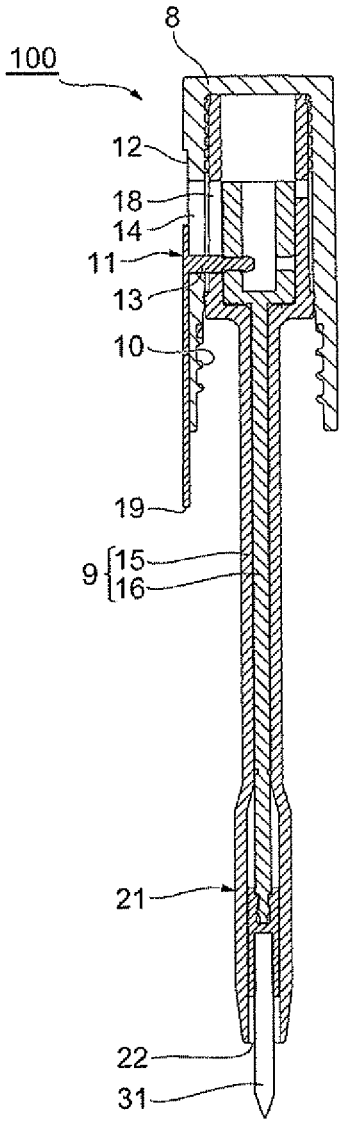
FIG. 7 is a longitudinal sectional view illustrating the cosmetic applicator shown in FIG. 6.
Figure 8:
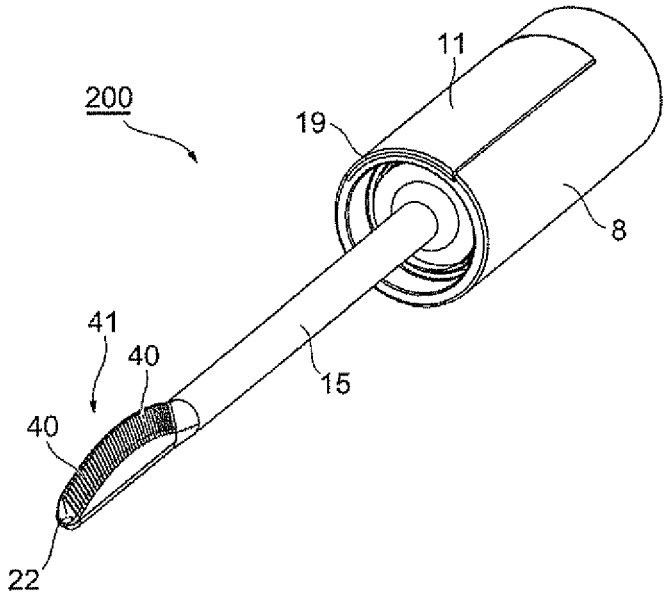
FIG. 8 is a perspective view illustrating the cosmetic applicator according to a second embodiment.
Figure 9:
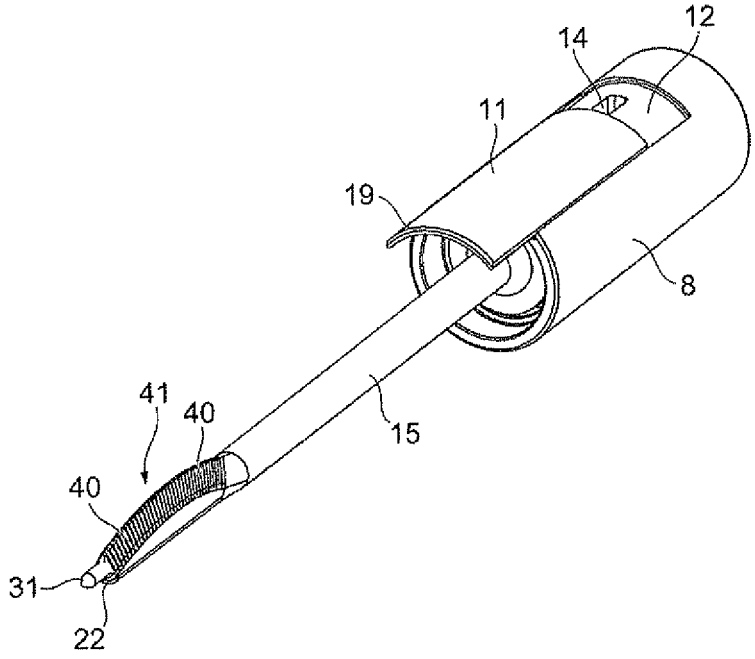
FIG. 9 is a perspective view illustrating the cosmetic applicator in a use position.
Figure 10:
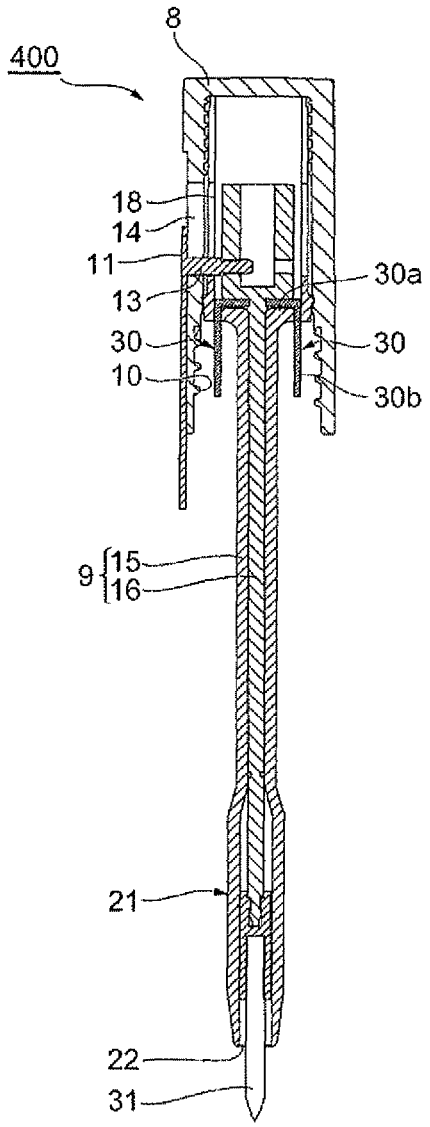
FIG. 10 is a longitudinal sectional view illustrating a cosmetic applicator according to a third embodiment, making the cosmetic applicator be positioned in a use position.
Figure 11:
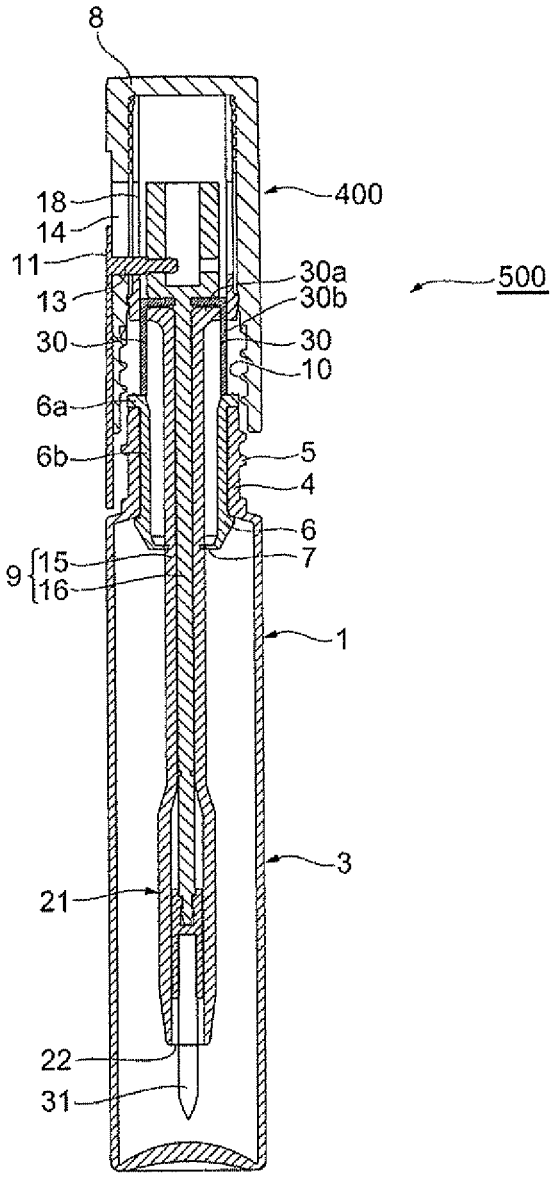
FIG. 11 is a longitudinal sectional view illustrating a state before the cosmetic applicator of FIG. 10 being attached onto a container main body.
Figure 12:
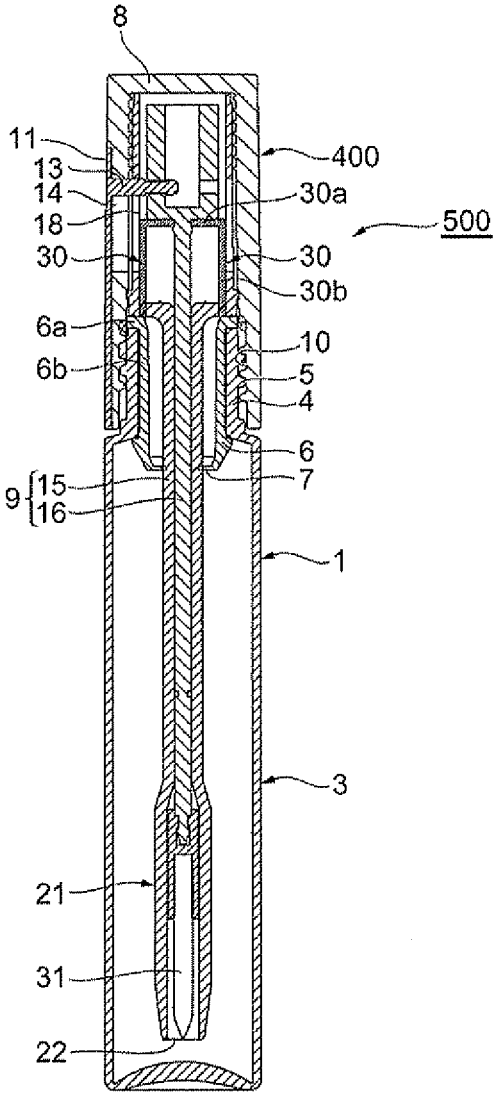
FIG. 12 is a longitudinal sectional view illustrating a cosmetic container having the cosmetic applicator according to the third embodiment, in a state in which the cosmetic applicator of FIG. 10 being fixed onto the container main body.

Hereinafter, preferred embodiments of a cosmetic applicator and a cosmetic container according to the present invention will be described with reference to FIGS. 1 through 12. FIGS. 1 through 7 illustrate a first embodiment of the present invention, FIGS. 8 and 9 illustrate a second embodiment of the present invention, and FIGS. 10 through 12 illustrate a third embodiment of the present invention, respectively. It should be noted that common elements will be assigned the same reference numerals, and the overlapped description will be omitted.

At first, the first embodiment illustrated in FIGS. 1 through 7 will be described.

Figure 1:
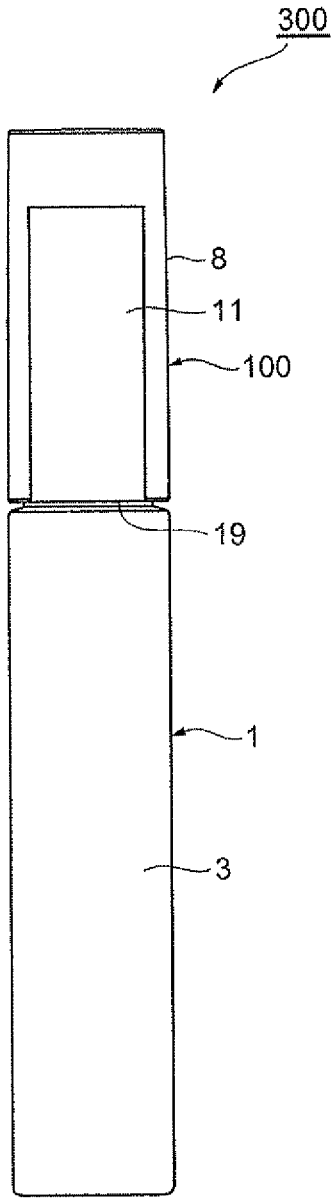
FIG. 1 is a front view illustrating a cosmetic container having a cosmetic applicator according to a first embodiment.
Figure 2:
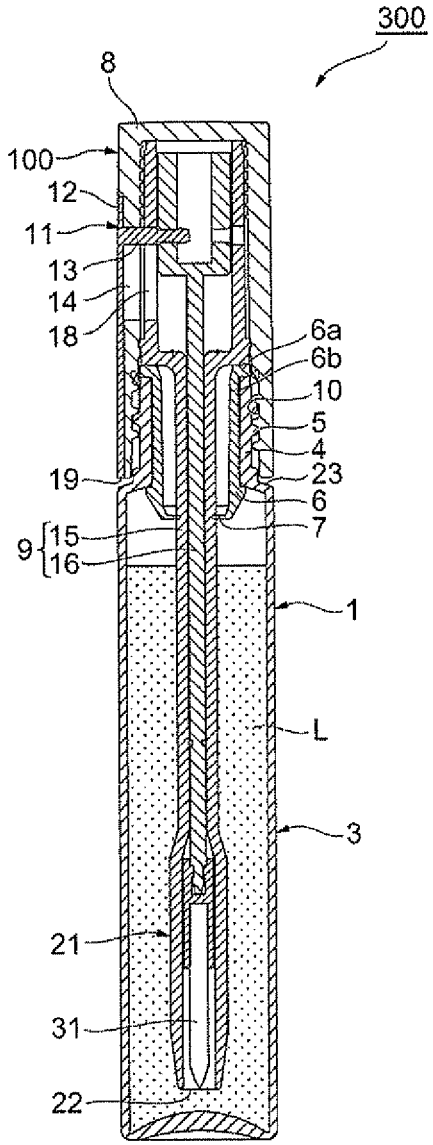
FIG. 2 is a longitudinal sectional view illustrating the cosmetic container shown in FIG. 1.
Figure 3:
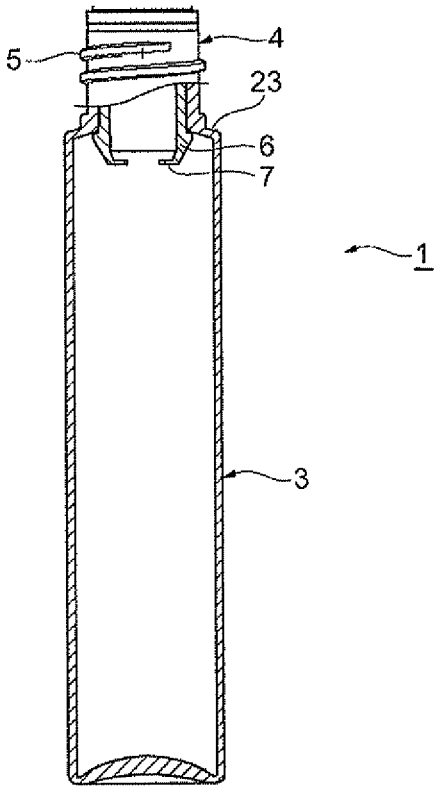
FIG. 3 is a partially broken/sectional front view illustrating the container main body shown in FIGS. 1 and 2.
Figure 4:
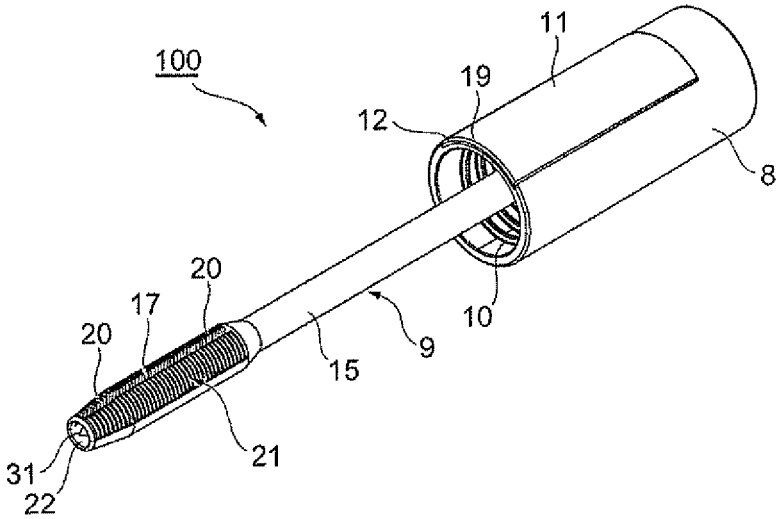
FIG. 4 is a perspective view illustrating the cosmetic applicator shown in FIGS. 1 and 2.
Figure 5:
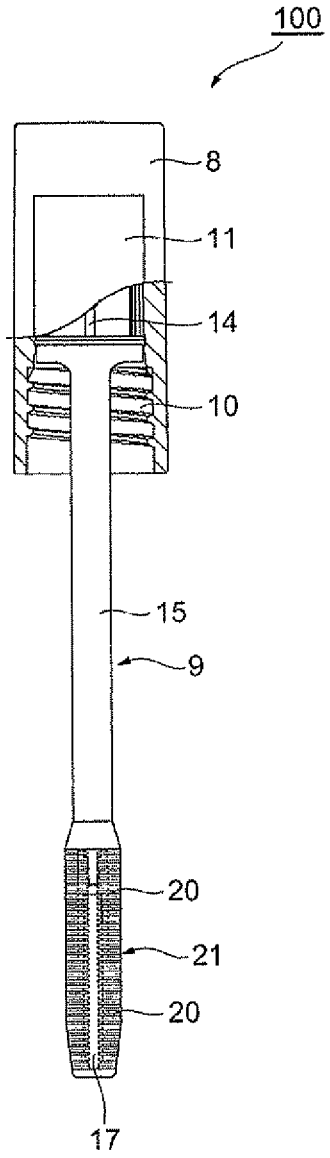
FIG. 5 is a partially sectional front view illustrating the cosmetic applicator shown in FIG. 4.

FIG. 1 is a front view illustrating the cosmetic container provided with the cosmetic applicator according to the first embodiment; FIG. 2 is a longitudinal sectional view of FIG. 1; FIG. 3 is a partially sectional front view illustrating the container main body; FIGS. 4 through 7 are views respectively illustrate the cosmetic applicator; whereas FIGS. 4 and 5 are the views illustrating the make-up applicator positioned at an initial position, and FIGS. 6 and 7 are views illustrating the make-up applicator positioned at a use position. The cosmetic container according to the embodiment is used to apply mascara on the eyelashes for increasing the volume of the eyelashes, and to apply eyeliner on the eyelids.

As shown in FIGS. 1 and 2, a cosmetic container 300 is a bottle-type container which substantially includes a container main body 1 for holding or accommodating a mascara liquid L, and a cosmetic applicator 100 which is attached to the container main body 1 in a detachable manner, so as to function as a top cover (cap) of the container main body 1, and as an applicator of the mascara liquid L. The cosmetic applicator 100 further includes a make-up comb (simply called as "comb", hereinafter) 21 for applying the mascara liquid L onto the eyelashes and a make-up applicator (simply called as "applicator", hereinafter) 31 for applying the eyeliner onto the eyelids, although details thereof will be described later.

As shown in FIGS. 1 through 3, the container main body 1 is provided with a accommodation portion 3 for accommodating the mascara liquid L, and an opening neck portion 4 that is integrally provided on the upper portion of the accommodation portion 3, so as to be continuously connected thereto.

The accommodation portion 3 is formed in a cylindrical shape having a bottom face, so as to accommodate the mascara liquid L therein. The opening neck portion 4 is a cylindrical portion in small diameter, which is continuously provided on the upper face 23 of the accommodation portion 3 in a coaxial state, and the interior of the cylinder portion thereof communicates with the interior of the accommodation portion 3. In the opening neck portion 4, an external thread 5 is formed on the outer peripheral surface, so that the cosmetic applicator 100 is screwed therewith in a detachable manner. Meanwhile, on the inner peripheral surface of the opening neck portion 4, a cylindrical inner plug portion 6 made of plastic, rubber, or the like, is mounted in a fixed manner. The inner plug portion 6 includes a cylinder portion **6*b* which abuts on the inner peripheral surface of the opening neck portion 4, a flange portion 6*a* which is continuously provided on the cylinder portion 6*b* and abuts on the upper surface of the opening neck portion 4, and a scraping portion 7 which is provided on the lower portion of the cylinder portion 6*b* so as to scrape off the excess amount of mascara liquid L adhering to the comb 21 when the comb 21** passes therethrough.

As shown in FIGS. 1 and 2, the cosmetic applicator 100 includes a grip portion 8 which serves as a top cover of the container main body 1 and also as a grip to be held by the user, and a shaft body 9 which projects from the interior of the grip portion 8 toward the side of the accommodation portion 3 (downward in FIG. 2) of the container main body 1.

The grip portion 8 is formed in a cylindrical shape having a bottom face, and disposed such that the bottom face thereof being positioned on the upper side, and as shown in FIGS. 2, 4 through 7, an internal thread 10 which is screwed into the external thread 5 on the outer peripheral surface of the opening neck portion 4 is disposed on the opening end side of the inner peripheral surface of the grip portion 8. Therefore, the grip portion 8 is attached to the container main body 1 in a detachable manner by screwing the internal thread 10 into the external thread 5.

A part of a peripheral wall of the grip portion 8 located at the outer peripheral surface side thereof is cut out from the other portion of the peripheral wall, so as to be formed as a thin-walled operating portion 11 which is extended in the axial direction, having a cross sectional shape thereof being formed in a circular-arc shape. This operating portion 11 is held within a concave portion 12 that is a remaining portion provided by cutting out the operating portion 11 from the peripheral wall of the grip portion 8. The lower end of the concave portion 12 is opened outward. A connecting pin 13 which further projects inward is provided on the inner surface of the operating portion 11, and a guide slit 14 extending in the axial direction to connect the inner and outer portions is provided on the bottom face of the concave portion 12 opposite to the connecting pin 13, and therefore, the connecting pin 13 of the operating unit 11 penetrates to the interior of the grip portion 8 via the guide slit 14. As a result, the operating unit 11 is capable of sliding in the axial direction while the connecting pin 13 being guided by the guide slit 14.

The shaft body 9 includes a cylindrical outer shaft body 15 mounted on the grip portion 8, and an inner shaft body 16 housed within the outer shaft body 15 in a movable manner.

The outer shaft body 15 is configured to be projected from the grip portion 8 with a leading end thereof being extended near to the bottom face of the accommodation portion 3 when the cosmetic applicator 100 is attached to the container main body 1 (see, FIG. 2). Further, the comb 21 provided with comb-teeth 20 arranged in the axial direction is provided on the outer peripheral surface of the leading end of the outer shaft body 15.

Meanwhile, on a portion where the comb 21 of the outer shaft body 15 is provided, at least one slit 17 (here, one slit) which communicates between the interior and exterior of the outer shaft body 15 and extends in the axial direction, is provided. When the cosmetic applicator 100 is attached to the container main body 1, the slit 17 serves as an opening to allow the mascara liquid L to penetrate into the interior portion of the outer shaft body 15. Due to the slit 17 cutting across the comb-teeth 20, each of the comb-teeth 20 is formed in a circular-arc shape when viewed in the axial direction, whereas the comb 21 is configured such that a number of comb-teeth 20 are arranged at intervals in the circumferential direction over a predetermined length in the axial direction from the vicinity of the leading end of the outer shaft body 15 (i.e., configured in a state where a number of concavo-convex portions are arranged consecutively).

Further, on the peripheral wall at the upper portion of the outer shaft body 15, a guide slit 18, which is similar to the guide slit 14 of the grip portion 8, is provided to overlap with the guide slit 14, and thus it is configured such that the connection pin 13 of the operating portion 11 penetrates to the interior of the outer shaft body 15 via the guide slit 18.

The inner shaft body 16 is formed in slightly shorter length than that of the outer shaft body 15 and housed within the outer shaft body 15, so as to be capable of slide movement in the axial direction (up-and-down direction) while being guided along the inner peripheral surface of the outer shaft body 15. The connection pin 13 penetrating to the interior of the outer shaft body 15 via the guide slits 14 and 18 is connected the upper portion of the inner shaft body 16.

Accordingly, it is configured such that when the operating portion 11 slides in the axial direction while the connection pin 13 is guided by the guide slits 14 and 18, in conjunction with the slide movement of the operating portion 11 in the axial direction, the inner shaft body 16 slides in the axial direction while being guided by the outer shaft body 15.

An applicator 31 is provided on the leading end of the inner shaft body 16. The applicator 31 is a brush such as a tip-shaped brush, a spiral-shaped brush, for example, which can be impregnated with cosmetic material. In this embodiment, a tip-shaped tapered brush is taken as an example.

As shown in FIG. 2, when the grip portion 8 of the cosmetic applicator 100 is attached to the opening neck portion 4 of the container main body 1 by screwing the internal thread 10 into the external thread 5, (i.e., the grip portion 8 is fastened), a shaft body 9 penetrates to the interior of the accommodation portion 3 of the container main body 1 through a tube hole of the inner plug 6. Here, the above condition is called "initial state". In the initial state, as shown in FIGS. 1, 2, 4, and 5, the operating portion 11 is held within the concave portion 12, and leading end portion 19 of the operating portion 11 is positioned in a same plane as the open end of the grip portion 8, so that the leading end portion 19 does not project from the open end. At the same time, the tip portion of the applicator 31 is configured so as not to project from an opening 22 on the leading end of the outer shaft body 15.

In the initial state, the comb 21 on the leading end of the outer shaft body 15 is dipped into the mascara liquid L held within the accommodation portion 3, whereas the applicator 31 on the leading end of the inner shaft body 16 is dipped into the mascara liquid L that penetrates to the interior of the outer shaft body 15 from the opening 22 on the leading end of the outer shaft body 15, and further penetrates thereto from the slit 17 on the leading end of the outer shaft body 15, so that the comb 21 and the applicator 31 are completely impregnated with the mascara liquid L. Meanwhile, in the initial state, a lower surface of a bottom portion in a large-diameter on the upper portion of the outer shaft body 15 abuts on a top portion of the flange portion **6*a* on the inner plug portion 6**.

With the cosmetic applicator 300 configured as such, in the case where the cosmetic applicator 100 is used, from the initial state as illustrated in FIGS. 1 and 2, the user holds and turns the grip portion 8 to unscrew the external thread 5 and internal thread 10, and pulls the grip portion 8 out to detach the cosmetic applicator 100 from the container main body 1. Through this, the shaft body 9 passes through the scraping portion 7 of the inner plug portion 6, and at this time, the excess amount of mascara liquid L adhering to the comb 21 of the outer shaft body 15 is scraped off.

In this manner, when the make-up by use of the comb 21 is applied by detaching the cosmetic applicator 100 from the container main body 1, as shown in FIGS. 4 and 5, the mascara liquid L can be applied on the eyelashes by the comb 21 at the initial state in which the applicator 31 disposed on the leading end of inner shaft body 16 is drawn in from the opening 22 on the leading end of the outer shaft body 15 and housed within the interior of the outer shaft body 15.

Further, when the make-up is applied by use of applicator 31 through operating the operating portion 11 by the user, the operating portion 11 slides from the position indicated in FIGS. 4 and 5 toward the leading end of the shaft body 9. Through this, as shown in FIGS. 6 and 7, in conjunction with the movement thereof, the inner shaft body 16 slides in a same manner, and as a result, the applicator 31 on the leading end of the inner shaft body 16 is moved from the initial position to the use position where the applicator 31 is projected from the opening 22 on the leading end of the outer shaft body 15, so that the eyeliner can be applied on the eyelids by use of the applicator 31.

When the make-up has been applied by use of the applicator 31, due to the operation of the operating portion 11 by the user, the operating portion 11 slides from the position indicated in FIGS. 6 and 7 in the opposite direction. As a result, as shown in FIGS. 4 and 5, in conjunction with the movement, the inner shaft body 16 slides in a same manner, so that the applicator 31 on the leading end of the inner shaft body 16 returns from the use position to the initial position where the applicator 31 is drawn in from the opening 22 on the leading end of the outer shaft body 15 and housed within the interior of the outer shaft body 15. After that, the user turns the grip portion 8 of the cosmetic applicator 100 in the direction opposite to the unscrewing direction to screw the internal thread 10 into the external thread 5, thus causing the grip portion 8 to be attached to the container main body 1.

As described thus far, in the embodiment, in the case where the make-up is applied by use of the comb 21, the make-up can be applied in a state in which the applicator 31 is drawn in from the leading end of the outer shaft body 15 and housed within the interior of the outer shaft body 15, and in the case where the make-up is applied by use of the applicator 31, the make-up can be applied by making the applicator 31 be projected from the leading end of the outer shaft body 15 due to the operation of the operating portion 11 by the user. Accordingly, it is possible to apply the make-up by use of make-up comb 21 or the make-up applicator 31 in a proper manner in accordance with the usage thereof, and also to avoid a risk of adhesion of the mascara liquid L of the make-up applicator 31 when the make-up is applied by use of the make-up comb 21, and thus it is possible to improve the usability.

In addition, in the case where the user forgets to return the operating portion 11 (i.e., forgets to make the operating portion 11 slide and return to the initial position), and attaches the grip portion 8 serving as a top cover of the cosmetic applicator 100 to the opening neck portion 4 in a state in which the applicator 31 is still projected from the leading end of the outer shaft body 15, an auto-return mechanism of the operating unit allows the leading end portion 19 of the operating portion 11 to slide in the opposite direction while abutting on the upper face 23 of the accommodation portion 3, so that the operating portion 11 and the applicator 31 return to the initial positions. As a result, the cosmetic container having an excellent usability can be realized.

Meanwhile, in this embodiment, as a preferred embodiment of the invention, the mascara is exemplified as the cosmetic material used for the cosmetic container 300, however, by using the liquid type cosmetic material other than the mascara, the comb 21 and the applicator 31 can be used for applying some other cosmetic material. Incidentally, in the case where the liquid type cosmetic material with low viscosity is used, the slit 17 may not be required as long as the applicator 31 housed within the outer shaft body 15 can be impregnated with the liquid type cosmetic material penetrating thereto from the opening 22 on the leading end of the outer shaft body 15. In addition, each of the comb-teeth 20 can be formed circular-ring shape when viewed from the axial direction.

FIG. 8 is a perspective view illustrating a cosmetic applicator according to the second embodiment. FIG. 9 is a perspective view illustrating the cosmetic applicator in the use position.

There is a structural difference between the cosmetic applicator 100 in the first embodiment and a cosmetic applicator 200 in the second embodiment that the comb 21 in the first embodiment is provided with comb-teeth 20 each of which is formed in either a circular-ring shape or a circular-arc shape, arranged in parallel in the axial direction when viewed from the axial direction, while the comb 41 in the second embodiment is provided with comb-teeth 40 each of which is formed in a mountain-shaped (i.e., triangular shape) projecting outward in one side of the outer shaft body 15, arranged in parallel in one line along the axial direction to form the comb 41 to be in an arch shape. In the second embodiment, the comb 21 used in the first embodiment has been replaced with the comb 41.

Meanwhile, based on the shape of the comb 41 that is formed in an arch shape, the leading end of the outer shaft body 15 is formed in a shape that is slightly curved in one side, however, the configuration in which the applicator 31 is projected from and housed within the leading end of the outer shaft body 15 due to the operation of the operating portion 11 by the user, is the same as that of the first embodiment.

It is needless to say that the same operations and effect achieved in the first embodiment can also be achieved in the aforementioned second embodiment.

FIG. 10 is a longitudinal sectional view illustrating a cosmetic applicator according to the third embodiment, making a make-up applicator be positioned in the use position, FIG. 11 is a longitudinal sectional view illustrating a state before the cosmetic applicator of FIG. 10 is attached to a container main body, and FIG. 12 is a longitudinal sectional view illustrating the cosmetic container having the cosmetic applicator according to the third embodiment, in a state an which the cosmetic applicator of FIG. 10 being attached to the container main body.

Difference between a cosmetic container 500 in the third embodiment and the cosmetic container 300 in the first embodiment lies in that a cosmetic applicator 400 having an auto-return mechanism which is different from the auto-return mechanism of the operating portion of the first embodiment, has been employed instead of the cosmetic applicator 100 in the first embodiment.

In the cosmetic applicator 400 according to the third embodiment, L-shaped return members 30 are provided as components of the auto-return mechanism of the operating portion. Each of the return members 30 includes a latch portion **30*a* for latching onto the outer shaft body 15 which constitutes an L-shape and extends in the horizontal direction, and a projecting portion 30*b* which constitutes an L-shape and extends in the vertical direction. A pair of return members 30 is provided so as to oppose with each other on a large-diameter portion on the upper portion of the shaft body 9**.

The latch portion **30*a* is positioned between the lower surface of the bottom portion of the large-diameter portion on the upper portion of the inner shaft body 16 and the upper surface of the bottom portion of the large-diameter portion on the upper portion of the outer shaft body 15, whereas the projecting portion 3*b* penetrates the bottom portion of the large-diameter portion on the upper portion of the outer shaft body 15, and projects further downward. In the initial state (the state in which the grip portion 8 is attached to the opening neck portion 4) as illustrated in FIG. 12, the upper surface of the latch portion 30*a* abuts on the lower surface of the bottom portion of the large-diameter portion on the upper portion of the inner shaft body 16, whereas the lower end surface (leading end surface) of the projecting portion 30*b* abuts on the top surface of the flange portion 6*a* of the inner plug portion 6, and in this condition, a gap having a predetermined length in the axial direction is provided between the lower surface of the latch portion 30***a* and the upper surface of the bottom portion of the large-diameter portion on the upper portion of the outer shaft body 15.

According to the third embodiment, from the initial state illustrated in FIG. 12, when the cosmetic applicator 400 is detached from the container main body 100 for use, and the inner shaft body 16 slides to the use position due to the operation of the operating portion 11, and as shown in FIG. 10, the applicator 31 comes at the use position where the applicator 31 is ready to use. Further, in conjunction with the slide movement of the inner shaft body 16, the return members 30 are pushed out, while the latch portions 30*a* come into a state where the latch portions 30*a* are sandwiched between the lower surface of the bottom portion of the large-diameter portion on the upper portion of the inner shaft body 16 and the upper surface of the bottom portion of the large-diameter portion on the upper portion of the outer shaft body 15, as shown in FIG. 10.

In the case where the user forgets to return the operating portion 11 and the grip portion 8 of the cosmetic applicator 400 is attached to the opening neck portion 4, the lower end surfaces of the projecting portions 30*b* slide in the opposite direction while abutting on the top surface of the flange portion 6*a* of the inner plug portion 6, and as a result, the inner shaft body 16 is pushed upward. Through this, the applicator 31 and the operating portion 11 are returned to the initial positions respectively, as shown in FIGS. 11 and 12.

Accordingly, in the third embodiment as well, in a same manner as described in the first embodiment, the applicator 31 and the operating portion 11 are automatically returned even if the user forgets to return the operating portion 11. As a result, the cosmetic container having the excellent usability can be realized.

Meanwhile, the latch portions 30*a* of the return members 30 and the inner shaft body 16 may be fixed, or may not be fixed.

Although the present invention has been described in detail thus far based on the embodiments, the present invention is not limited to the aforementioned embodiments. For example, the cosmetic applicators 100, 200, 400 which are detachable with respect to the container main body 1 by the external thread 5 and internal thread 10 are described in the above embodiments, however, the present invention is also applicable to the cosmetic applicators 100, 200, and 400 which are detachable with respect to the opening neck portion 4 by pushing and fitting into the opening neck portion 4.

Further, it is preferable to employ a mechanism so-called "slide-click mechanism" in which the applicator 31 slides, while making a locking sound or a "click" sound accompanied by haptic sense of resistance when the operating portion 11 slides, and at every "click", the user can recognize a projection state (movement state) of the applicator 31, and can make the applicator 31 stop at respective positions.

Meanwhile, it is also preferable that, in a state in which the applicator 31 be projected from the leading end of the outer shaft body 15, the applicator 31 be restored within the outer shaft body 15 by a spring action upon a press of a button, for example.

What is claimed is:

1. A cosmetic applicator for applying cosmetic material comprising:

a shaft body;

a make-up comb provided with comb-teeth arranged in an axial direction on an outer peripheral surface of a front end of the shaft body;

a make-up applicator housed within the shaft body;

a grip portion provided on a base end of the shaft body; and an operating portion provided on the grip portion and connected to the make-up applicator;

wherein the make-up applicator is projected from and housed within the front end of the shaft body due to an operation of the operating portion by a user;

wherein the shaft body includes an outer shaft body mounted on the grip portion, and an inner shaft body housed within the outer shaft body in a movable manner;

wherein the inner shaft body is shorter in length than the outer shaft body.

2. A cosmetic applicator as set forth in claim 1, wherein each of the comb-teeth is formed in a circular-ring shape or a circular-arc shape when viewed from the axial direction, and said make-up comb is formed so that a plurality of comb-teeth are arranged in parallel along the axial direction.

3. A cosmetic applicator as set forth in claim 1, wherein the make-up comb is formed so that the comb-teeth protrude outward on one side of the shaft body and are arranged in parallel in one line along the axial direction.

4. A cosmetic applicator as set forth in claim 1, wherein the make-up applicator is formed so as to slide in the axial direction in conjunction with a slide movement of the operating portion in the axial direction, so that the make-up applicator is projected from and housed within the front end of the shaft body.

5. A cosmetic container comprising:

a cosmetic applicator as set forth in claim 4; and a container main body including an accommodation portion for accommodating cosmetic material, whose interior and exterior being communicated with each other through an opening neck portion provided on an upper face of the accommodation portion;

wherein the grip portion is configured to be attached to the opening neck portion in a detachable manner and to function as a top cover of the cosmetic container, and the make-up comb is configured to penetrate to the accommodation portion through the opening neck portion when the grip portion is attached to the opening neck portion; and said cosmetic container is configured so that in the case where the grip portion is attached to the opening neck portion during a use state in which the grip portion is being detached from the opening neck portion and the make-up applicator is being projected from the front end of the shaft body by sliding from an initial position where the make-up applicator being housed within the shaft body due to the slide movement of the operating portion, a component of the cosmetic applicator is configured to slide in an opposite direction while abutting on a component of the cosmetic container main body to return the make-up applicator and the operating unit to the initial positions, respectively.

6. A cosmetic container as set forth in claim 5, wherein when the grip portion is attached to the opening neck portion, the operating portion serving as a component of the cosmetic applicator is configured to slide in the opposite direction while a leading end portion thereof abutting on a front surface of the accommodation portion serving as the component of the container main body to return the make-up applicator and the operating portion to the initial positions, respectively.

7. A cosmetic container as set forth in claim 5, wherein said cosmetic main body comprises an inner plug portion as a component thereof, said inner plug portion including a cylindrical portion abutting on an inner peripheral surface of the opening neck portion, a flange portion continuously provided on the cylindrical portion and abutting on an upper face of the opening neck portion, and a scraping portion provided on a lower portion of the cylindrical portion to scrape an excess amount of cosmetic material adhering to a make-up comb while the make-up comb passing therethrough, and wherein said cosmetic applicator for the cosmetic container comprises a projecting portion as a component thereof, said projecting portion provided in a movable manner in a slide movement direction so as to be pushed out along with the slide movement of the make-up applicator in a projecting direction, wherein when the grip portion is attached to the opening neck portion, the projecting portion is formed to slide in the opposite direction while the lower end portion thereof abutting on the flange portion of the inner plug portion thereby the make-up applicator and the operating portion are returned to the initial positions, respectively.

8. A cosmetic applicator as set forth in claim 1, wherein the operating portion is held within a concave portion formed in a peripheral wall of the grip portion.

9. A cosmetic applicator as set forth in claim 8, further comprising a connecting pin provided on an inner surface of the operating portion, such that the connecting pin projects inward toward the shaft body and connects to an upper portion of the inner shaft body; a first guide slit provided in the concave portion; and a second guide slit provided in an upper portion of the outer shaft body; wherein the first and second guide slits extend in an axial direction and overlap.

10. A cosmetic applicator as set forth in claim 9, wherein the connecting pin is slidably movable in the first and second guide slits along the axial direction such that a slide movement of the operating portion in the axial direction correspondingly slides the inner shaft body in the axial direction.

* * * * *